US010317030B2

(12) United States Patent
Alisafaee et al.

(10) Patent No.: US 10,317,030 B2
(45) Date of Patent: Jun. 11, 2019

(54) DUAL HIGH-BEAM AND LOW-BEAM VEHICLE HEADLAMP

(71) Applicant: Grote Industries, LLC, Madison, IN (US)

(72) Inventors: Hossein Alisafaee, Madison, IN (US); Albert J. Bolander, Jr., Madison, IN (US); Paul Miller, Madison, IN (US); Cesar Perez-Bolivar, Madison, IN (US)

(73) Assignee: Grote Industries, LLC, Madison, IN (US)

( * ) Notice: Subject to any disclaimer, the term of this patent is extended or adjusted under 35 U.S.C. 154(b) by 6 days.

(21) Appl. No.: 15/791,578

(22) Filed: Oct. 24, 2017

(65) Prior Publication Data

US 2019/0120457 A1 Apr. 25, 2019

(51) Int. Cl.

| | |
|---|---|
| ***F21S 41/25*** | (2018.01) |
| ***F21S 41/275*** | (2018.01) |
| ***F21S 41/32*** | (2018.01) |
| ***F21S 41/663*** | (2018.01) |
| ***F21S 41/151*** | (2018.01) |
| *F21S 41/20* | (2018.01) |

(52) U.S. Cl.

CPC ..... *F21S 41/275* (2018.01); *F21S 41/151* (2018.01); *F21S 41/32* (2018.01); *F21S 41/663* (2018.01); *F21S 41/28* (2018.01)

(58) Field of Classification Search

CPC ..... F21S 41/14; F21S 41/141; F21S 41/143; F21S 41/151; F21S 41/147; F21S 41/153; F21S 41/20; F21S 41/25; F21S 41/265; F21S 41/275; F21S 41/28; F21S 41/29; F21S 41/295; F21S 41/663; F21S 41/32

See application file for complete search history.

(56) References Cited

U.S. PATENT DOCUMENTS

| | | | | |
|---|---|---|---|---|
| 2004/0208018 | A1* | 10/2004 | Sayers | F21S 41/143 362/544 |
| 2008/0247188 | A1* | 10/2008 | Woodward | F21S 41/25 362/554 |
| 2014/0085920 | A1* | 3/2014 | Meyrenaud | F21S 41/265 362/545 |
| 2017/0276310 | A1* | 9/2017 | Nakazawa | F21S 41/275 |
| 2018/0010755 | A1* | 1/2018 | Park et al. | F21S 41/663 |

* cited by examiner

*Primary Examiner* — Y M. Lee
(74) *Attorney, Agent, or Firm* — Posz Law Group, PLC

(57) ABSTRACT

A headlamp assembly is provided that includes a circuit board that is attached to the bottom of a headlamp reflector and that includes a plurality of light emitting elements. The plurality of light emitting elements are arranged on the circuit board in a high-beam and low-beam producing pattern configured to generate light toward the outer edge of the headlamp reflector. The headlamp assembly also includes an optical lens that includes a first optical surface and a second optical surface. The optical lens optically forms a low-beam light pattern and a high-beam light pattern from the light generated from the plurality of light emitting elements through the optical lens.

14 Claims, 22 Drawing Sheets

DUAL HIGH-BEAM AND LOW-BEAM VEHICLE HEADLAMP

TECHNICAL FIELD

The present disclosure generally relates to a headlamp that contains a plurality of light emitting elements in an arrangement to generate a high-beam light pattern and a low-beam light pattern. More particularly, the present disclosure relates to structure in which the arrangement of light-emitting elements within the same device or assembly form a high-beam light pattern and a low-beam light pattern with the aid of an optical lens, and a method relating to the same.

BACKGROUND

Vehicles (e.g., automotive, agricultural, or military) typically include multiple headlamps in order to form high beams and low beams (e.g., driving beams and passing beams, respectively). One headlamp is typically designed to form a high-beam light pattern, and a separate headlamp is typically designed to form a low-beam light pattern. However, the use of multiple headlamps is not always desirable.

On the other hand, some conventional headlamps may include components to shield (or block) a part of the light generated from a light source in order to form different light patterns. However, this type of approach has several shortcomings. For example, this blocking or shielding approach may enlarge the overall size of a headlamp. The larger headlamp that includes one or more blocking or shielding mechanisms may be unsuitable or undesirable for particular applications.

The conventional blocking approach also requires movable parts in order to block a portion of the generated light. In addition to increasing the overall footprint of the headlamp, these parts break or otherwise need repair. Furthermore, conventional blocking or shielding techniques result in light pattern formations that are less precise or crisp compared to other approaches. This is because part of the light generated to form a particular light pattern may be blocked in this type of approach.

In addition to size and precision concerns, a conventional headlamp that blocks or shields a part of the generated light in order to produce a light pattern necessarily wastes power. This is because power is required to generate all of the light even if some of the light is ultimately blocked from the final light pattern. Thus, the conventional blocking approaches are also less energy efficient. The less energy-efficient headlamp of conventional approaches may be undesirable, since energy resources are limited in a vehicle.

SUMMARY

A headlamp assembly is provided that comprises a headlamp reflector that includes a bottom, an outer edge, and a curved sidewall that extends outwardly from bottom to define the outer edge; a circuit board that is attached to the bottom of the headlamp reflector and that includes a plurality of light emitting elements, the plurality of light emitting elements are arranged on the circuit board in a high-beam and low-beam producing pattern configured to generate light toward the outer edge of the headlamp reflector; an optical lens that is attached to the headlamp reflector, that includes a first optical surface and a second optical surface, and that is configured to optically form a low-beam light pattern and a high-beam light pattern from the light generated from the plurality of light emitting elements through the optical lens; and a housing that houses the circuit board, the plurality of light emitting elements, the optical lens, and the headlamp reflector.

The plurality of light emitting elements of the headlamp may include a first set of light emitting elements in a first light-beam pattern arrangement on the circuit board and a second set of light emitting elements in a second light-beam pattern arrangement.

The optical lens of the headlamp may be configured to optically form the low-beam light pattern from the light generated by the first set of light emitting elements. The optical lens of the headlamp may be configured to optically form the high-beam light pattern from the light generated by the second set of light emitting elements and one or more of the light emitting elements in the first set of light emitting elements.

The optical lens may be configured to optically form the low-beam light pattern from the light generated by the first set of light emitting elements, and the optical lens may be configured to optically form the high-beam light pattern from the light generated by the second set of light emitting elements.

The headlamp assembly may also include an outer protective-lens that is attached to headlamp housing to enclose the optical lens, the headlamp reflector, and the circuit board.

The optical lens of the headlamp may include a plurality of segments that outwardly extend from one of the first optical surface and the second optical surface of the optical lens. The first optical surface of the optical lens may be planar, and the plurality of segments may outwardly extend from the second optical surface of the optical lens.

The optical lens and the plurality of light emitting elements may cooperate to optically form one of the high-beam light pattern and the low-beam light pattern by selectively activating one of the first set and the second set or both, respectively, without shielding any components to optically form the low beam pattern.

Each of the light emitting elements in the first set of light emitting elements may extend in a same direction on the circuit board, and each of the light emitting elements in the second set of light emitting elements may extend in a same direction on the circuit board parallel to the first set of light emitting elements.

The first set of light emitting elements may include a first row and a second row of light emitting elements, and the second set of light emitting elements may include a first row and a second row of light emitting elements. The second row of the second set may be aligned adjacent to the first row and the second row of the first set such that the first row for the first set may be located in between the second row of the second set, and the second row of the second set may be closer to an outer edge of the circuit board than the first row and the second row of the first set of light emitting elements.

One or more of the plurality of light emitting elements in the high-beam and low-beam producing pattern on the circuit board may be staggered on the circuit board.

The plurality of the light emitting elements in the high-beam and low-beam producing pattern may be arranged in a matrix on the circuit board.

A headlamp assembly is provided that comprises a headlamp reflector that includes a bottom, an outer edge, and a curved sidewall that extends outwardly from bottom to define the outer edge; an optical lens that is attached to the headlamp reflector; a circuit board that is attached to the bottom of the headlamp reflector and that includes a plurality of light emitting elements; a high-beam set of the plurality of light emitting elements that is arranged on the circuit board in a high-beam producing pattern configured to optically form a high beam pattern from the light emitted from the high-beam set through the optical lens; a low-beam set of the plurality of light emitting elements, that is arranged on the circuit board in a low-beam producing pattern configured to optically form a low beam pattern from the light emitted from the high-beam set through the optical lens and that is different than, or mixed with at least one of, the high-beam set of the plurality of light emitting elements; and a housing that includes an outer protective-lens and that houses the circuit board, the plurality of light emitting elements, the optical lens, and the headlamp reflector.

A method for controlling a dual beam headlamp comprises at least the following: applying a first voltage level to activate a low-beam set of a plurality of light emitting elements attached to a circuit board within a housing of an vehicle headlamp; optically forming a low-beam pattern via the low-beam set of the plurality of light emitting elements without shielding any components of the vehicle headlamp to form the low-beam pattern; and applying a second voltage level different from the first voltage level to activate a high-beam set of the plurality of light emitting elements that are different from the high-beam set of the plurality of light emitting elements and that are attached to the circuit board within the housing of the vehicle headlamp; and optically forming a high-beam pattern via the high-beam set of the plurality of light emitting elements.

The method may also include projecting light emitted from the low-beam set of the plurality of light emitting elements through an optical lens within the housing of the vehicle headlamp to optically form the low-beam pattern, and projecting light emitted from the high-beam set of the plurality of light emitting elements through an optical lens within the housing of the vehicle headlamp to optically form the high-beam pattern.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present invention. These drawings are not necessarily drawn to scale.

DETAILED DESCRIPTION

Figure 1:
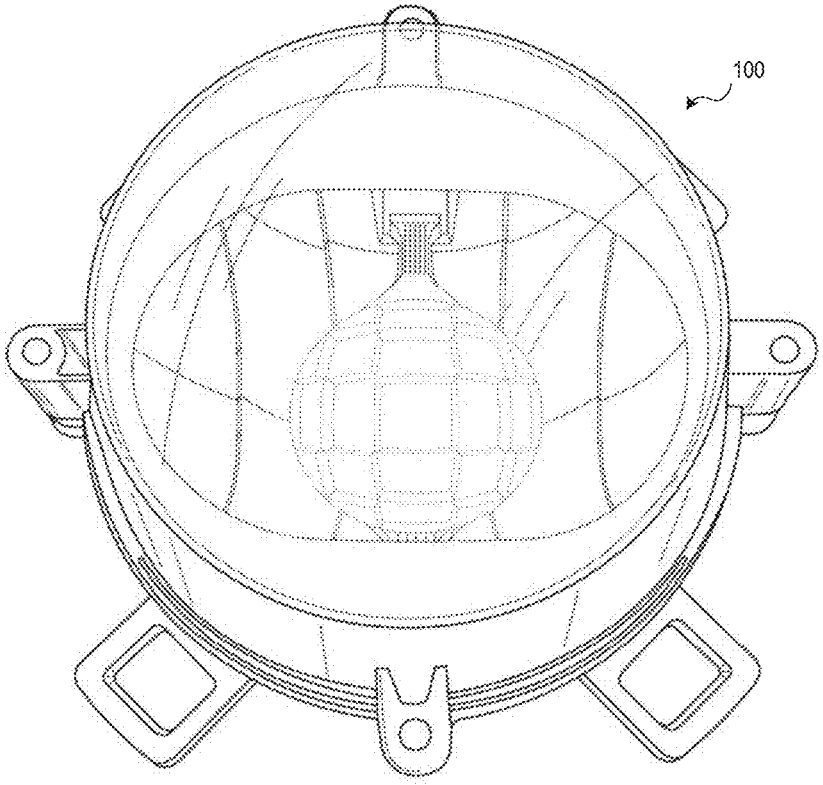
FIG. 1 is a perspective, top view of the dual high-beam and low-beam headlamp assembly according to the disclosed embodiments.

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order (i.e., processes or steps that are not so limited may be performed in any order).

Furthermore, elements having the same number represent the same element across the various figures, and throughout the disclosure. Their description is not always repeated for each embodiment, but may be inferred from previous descriptions. Elements that have the same number but have the addition of a letter designator indicate distinct embodiments of a more generic element.

The dual high-beam and low-beam vehicle headlamp 100 ("headlamp") includes an arrangement of light emitting elements 200 arranged on a circuit board 202. The headlamp 100 also includes an optical lens 208. The optical lens 208 and the arrangement of light emitting elements 200 cooperate to form a high-beam light pattern and a low-beam light pattern in the same headlamp 100.

The light emitting elements 200 can be any type of light emitting diode. For example. The light emitting element 200 can be a light-emitting diode (LED), an organic light-emitting diode (OLED), or any other type of light-emitting diode as will be understood by one skilled in the art. The light emitting elements 200 can be any color of light emitting diode.

The particular application and type of vehicle for the headlamp 100 is not particularly limited. For example, the vehicle can be an automotive vehicle, an agricultural vehicle, or a military vehicle, as will be understood by those skilled in the art.

Figure 2:
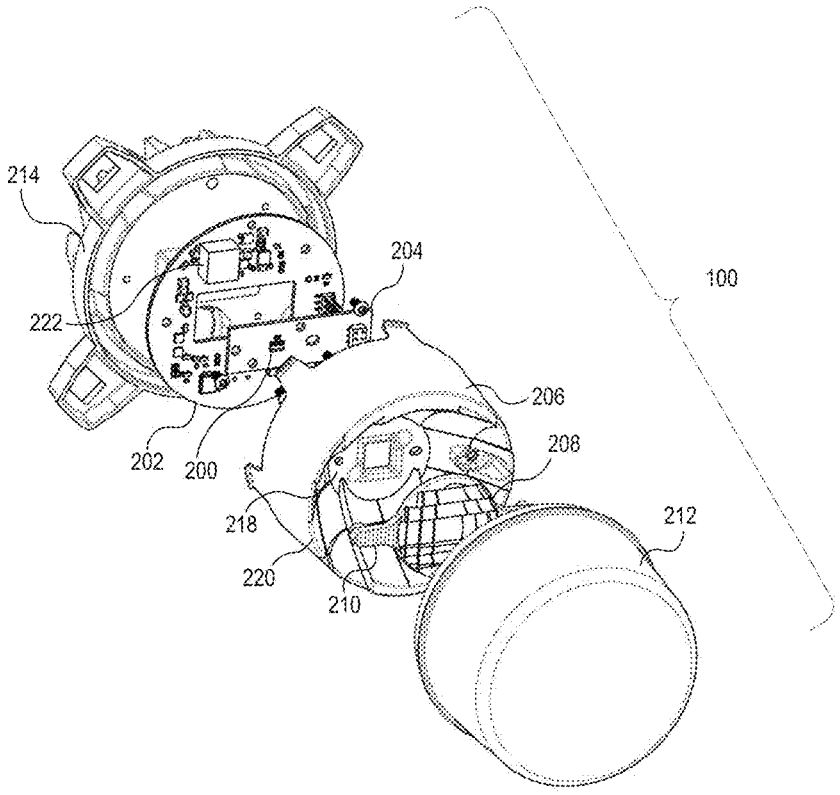
FIG. 2 is an exploded, perspective view of the dual high-beam and low-beam headlamp assembly according to the disclosed embodiments.

FIG. 1 shows a perspective overhead view of the headlamp 100. FIG. 2 shows an exploded view of the headlamp 100 that includes the components of the headlamp 100 in some of the embodiments of the headlamp 100.

As shown in FIG. 2, the headlamp 100 includes a plurality of light emitting elements 200 arranged on a circuit board 202 that may include a light emitting element driver 204. The circuit board 202, the light emitting element driver 204, and the plurality of light emitting elements 200 are electrically connected together. In some embodiments, the circuit board 202 may include a controller 222. The headlamp 100 also includes a headlamp reflector 206, such as a parabolic reflector. The headlamp 100 also includes an optical lens 208 ("optical lens" or "lens") that optically forms different light patterns in conjunction with the plurality of light emitting elements 200. The optical lens 208 may include arms 210 that extend from the optical lens and attach to a portion of the headlamp reflector 206.

The arms 210 of the optical lens 208 may attached to the curved sidewall 216 of the headlamp reflector 206 in some embodiments. In other embodiments, the arms 210 of the optical lens 208 may attached to the base 218 of the optical lens 208. The optical lens 208 may be located within the outer edge 220 of the headlamp reflector 206. In other embodiments, the optical lens 208 may be located outside of the outer edge 220 of the headlamp reflector 206. The arms 210 of the optical lens 208 may be removably attached to the optical lens 208. In other embodiments, the arms 210 of the optical lens 208 may continuously extend from the optical lens 208 and may be made of the same material as the optical lens 208.

The headlamp 100 also includes a housing 214 and a protective lens 212. The housing 214 and the protective lens 212 may attach together to house the components of the headlamp 100. The protective lens 212 protects the components of the headlamp 100. The protective lens 212 may include no optical properties in the light pattern formation. The optical lens 208 and the plurality of light emitting elements 200 optically form the different light patterns. This may occur without the aid of the protective lens 212.

FIGS. 3-6 show a cross-sectional view of the plurality of light emitting elements 200 and the optical lens 208 cooperating together to form a low-beam light pattern and a high-beam light pattern.

Figure 3:
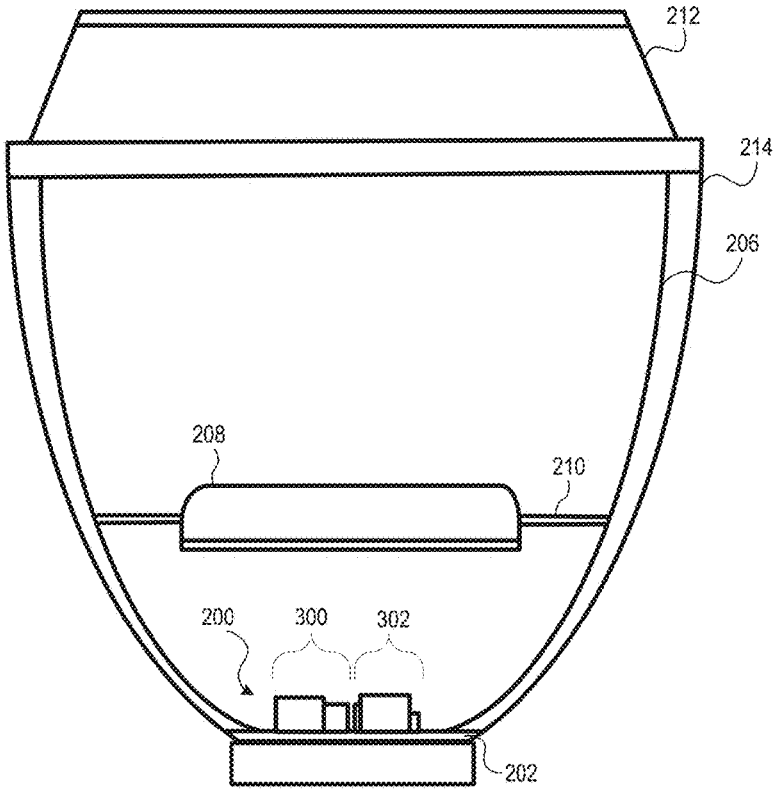
FIG. 3 is a cross-sectional view of a the dual high-beam and low-beam headlamp assembly according to the disclosed embodiments.

FIG. 3 shows a headlamp 100 that includes a housing 214 and a protective lens 212 that houses the headlamp reflector 206, the plurality of light emitting elements 202 attached to the circuit board 202, and the lens 208, which is attached to the inner sidewall of the reflector 206 in some embodiments. The plurality of light emitting elements 202 may include at least two different sets of light emitting elements 300, 302. FIG. 3 shows a first set of light emitting elements 300 ("first set") and a second set of light emitting elements 302 ("second set"). Each of the first set 300 and the second set 302 of light emitting elements 200 includes a plurality of different light emitting elements 200, as shown in FIGS. 3-6. Each of the plurality of light emitting elements 200 generate (or emit) light towards the optical lens 208.

Figure 4:
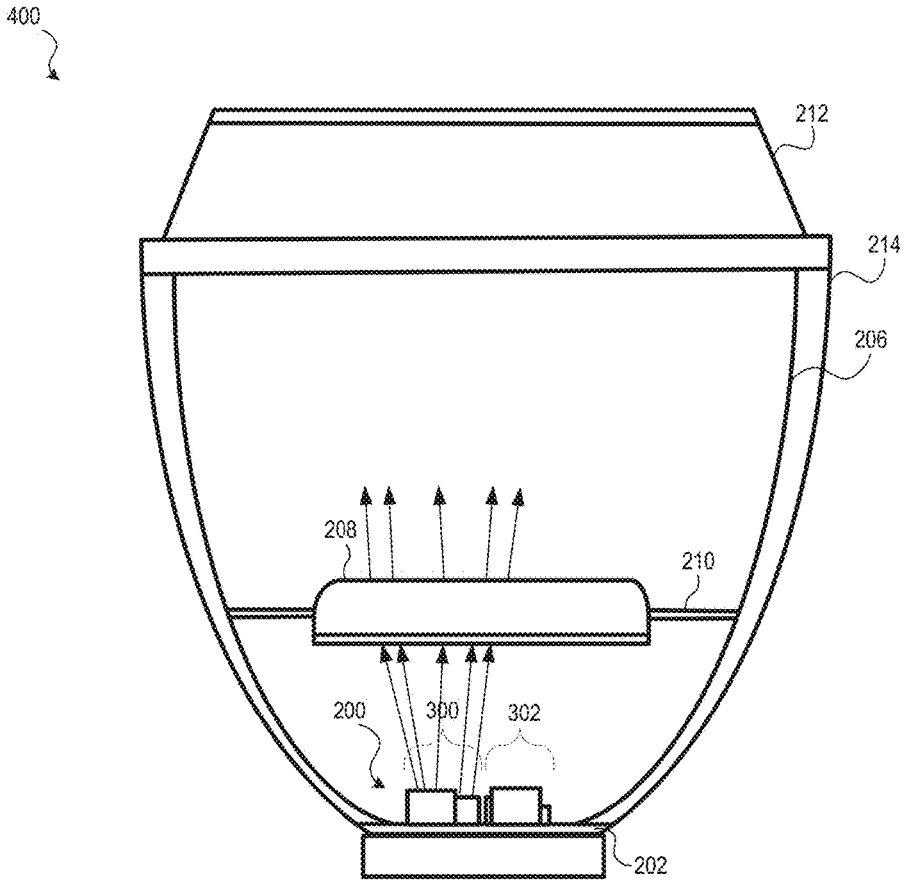
FIG. 4 is a cross-sectional view of a the dual high-beam and low-beam headlamp assembly generating a low-beam light pattern according to the disclosed embodiments.

FIG. 4 shows the first set 300 of light emitting elements 200 generating light towards the optical lens 208. The configuration of the optical lens 208 optically projects the light generated by the first set 300 into a light pattern. The first set 300 of light emitting elements 200 and the optical lens 208 together form a low-beam light pattern. The reflector 206 may in some embodiments project and/or optically form the low-beam light pattern of the headlamp 100, as will be understood by one skilled in the art.

As shown in FIG. 4, no blocking occurs in the formation of the low-beam light pattern. That is, the plurality of light emitting elements 200 generate light directly to the optical lens 208. The optical lens 208 optically forms the low-beam light pattern without the aid of any blocking mechanism or structure.

Figure 5:
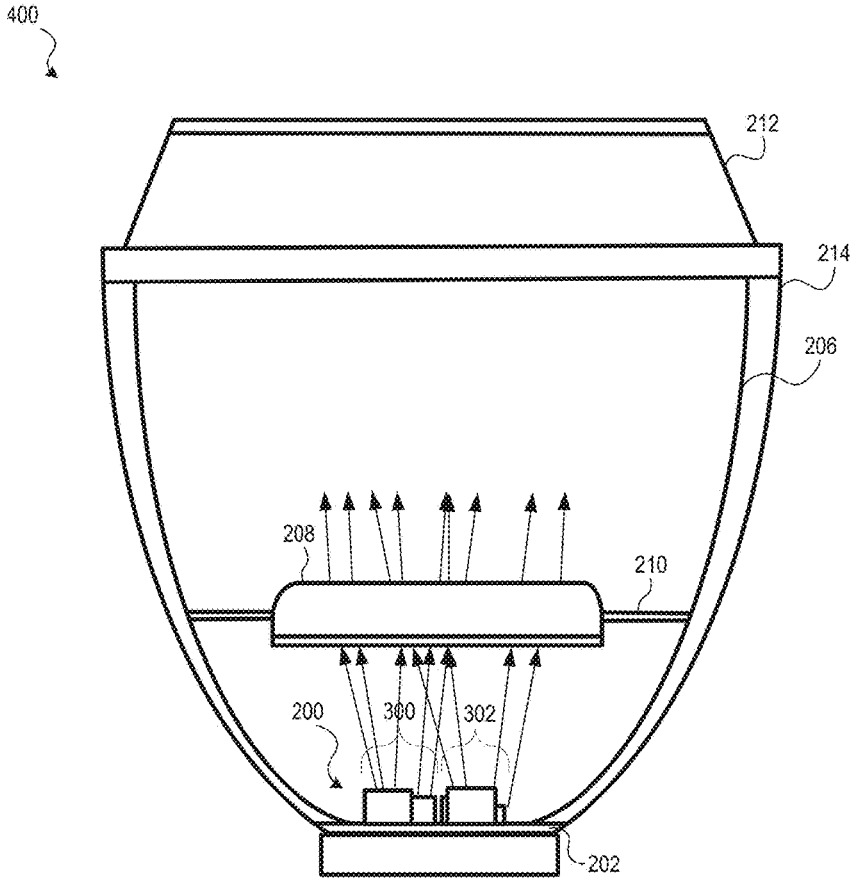
FIG. 5 is a cross-sectional view of a the dual high-beam and low-beam headlamp assembly generating a high-beam light pattern according to the disclosed embodiments.

The dual high-beam and low-beam headlamp 100 also forms a high-beam light pattern based on a combination of the plurality of light emitting elements 200 and the optical lens 208. FIG. 5 shows an arrangement 400 in which the second set 302 and the first set 300 together generate light to optically form the high-beam patter with the optical lens 208. In other words, FIG. 5 shows an arrangement 400 in which both the first set 300 and the second set 302 are turned on simultaneously. When both the second set 302 and one or more of the first set 300 of the plurality of light emitting elements 200 generate light towards the optical lens 208, the headlamp 100 projects a high-beam light pattern. The reflector 206 may in some embodiments project and/or optically form the high-beam light pattern of the headlamp 100, as will be understood by one skilled in the art.

However, the disclosed embodiments are not limited to this particular arrangement. For example, the second set 302 of light emitting elements 200 and the optical lens 208 may together form a high-beam light pattern without the first set 300 of light emitting elements 200. This can be seen in FIG. 6 in which an arrangement 600 forms a high-beam light pattern while the first set 300 are turned OFF.

Figure 6:
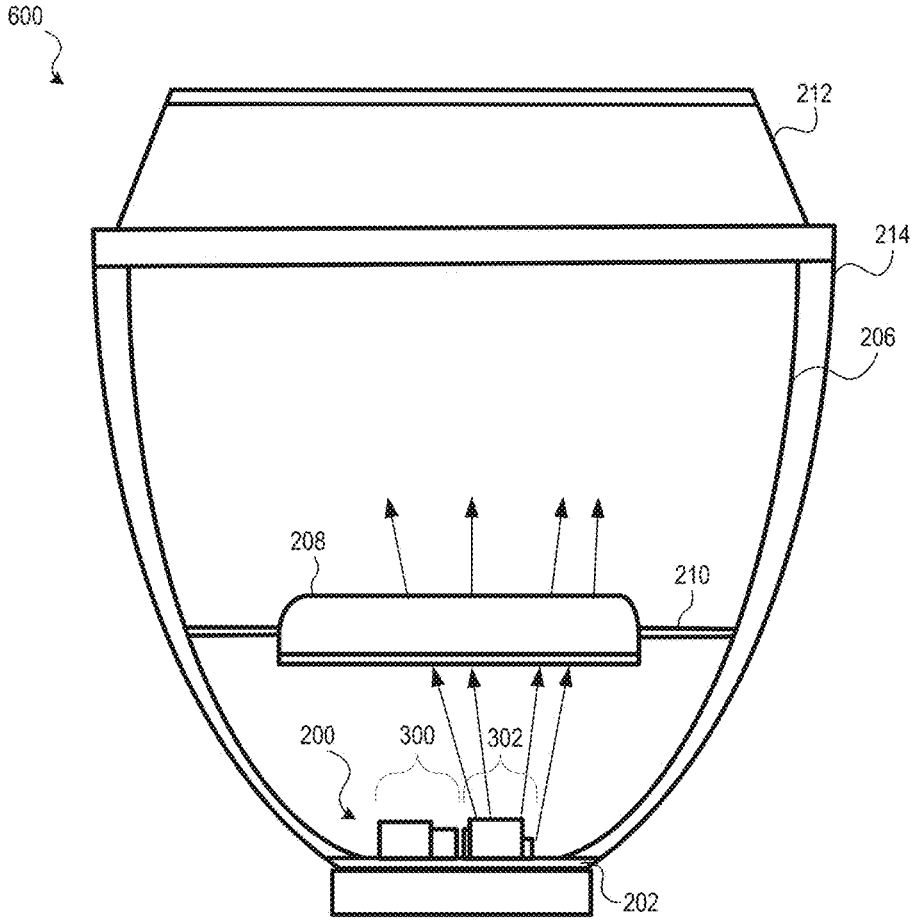
FIG. 6 is a cross-sectional view of a the dual high-beam and low-beam headlamp assembly generating a high-beam light pattern according to the disclosed embodiments.

As shown in FIGS. 4-6, the headlamp 100 optically forms a high-beam light pattern and a low-beam light pattern without blocking or shielding the light emitting elements 200. Instead, the light emitting elements 200 selectively turned on to generate a high-beam light pattern or a low-beam light pattern. This results in, for example, a more crisp and precise light pattern, because none of the light is blocked. Instead, all of the currently generated light is being used via the optical lens 208 and/or the reflector 206 to form the light patterns.

The headlamp 100 may be considered energy efficient, since it produces a low-beam light pattern without wasting any generated light. That is, the optical lens 208 optically forms the low-beam light pattern by utilizing all of the light generated by the plurality of light emitting elements 200. Since none of the light is blocked, the headlamp 100 utilizes energy more efficiently. In addition, the resulting light patterns are more crisp, sharp, and precise since the headlamp 100 utilizes all of the generated light.

The arrangement of the plurality of light emitting elements 200 on the circuit board 202 is not particularly limited. The arrangement of the plurality of light emitting elements 200 allows the light emitting elements 200 and the optical lens 208 to optically form a high beam light pattern and a low beam light pattern. Some embodiments include only the first set 300 and the second set 302 of the plurality of light emitting elements 200. However, other embodiments include additional light emitting elements 200.

Furthermore, different regulatory requirements in different countries may require different light beam light patterns. For example, a low-beam light pattern required by the US Department of Transportation ("DOT") is different than a low-beam light pattern required in other countries, such as the requirements in Europe by the Economic Commission for Europe ("ECE"). Because of this, different arrangements of the plurality of light emitting elements may be used in the headlamp 100 to generate limit and optically produce a light pattern with the optical lens 208 in order to satisfy these regulatory requirements.

Figure 7:
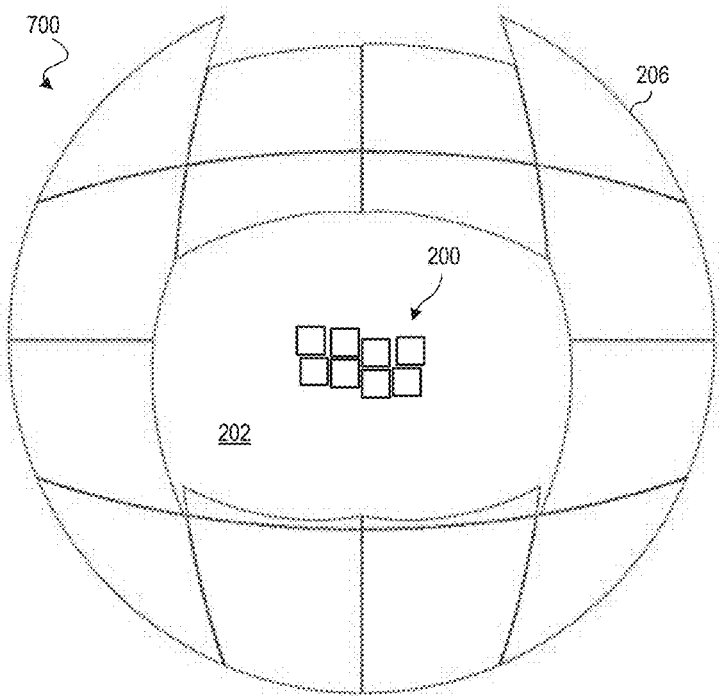
FIG. 7 is a top view of the dual high-beam and low-beam headlamp assembly having an arrangement of light emitting elements according to the disclosed embodiments.
Figure 8:
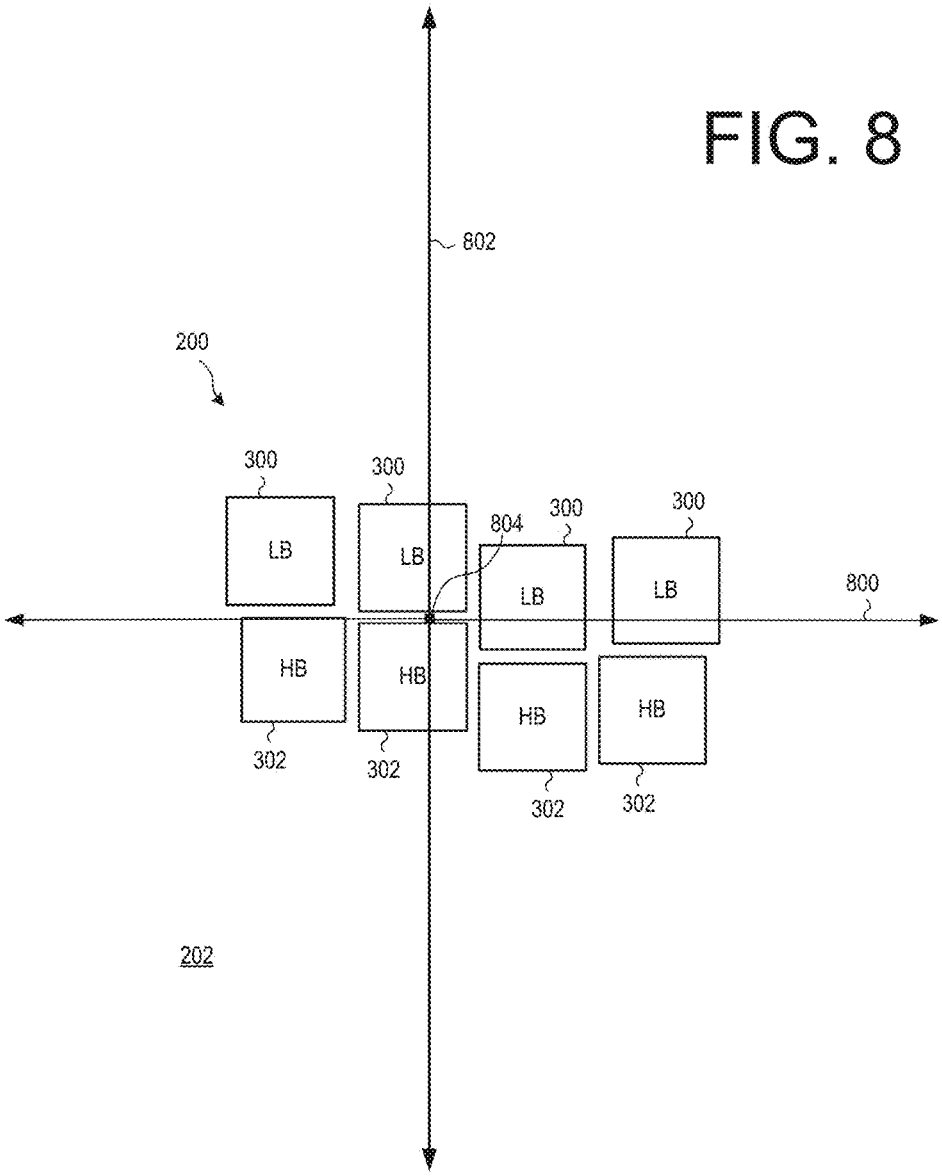
FIG. 8 is a close-up view of the dual high-beam and low-beam headlamp assembly having an arrangement of light emitting elements shown in FIG. 7 according to other disclosed embodiments.

FIGS. 7 and 8 show an arrangement 700 of light emitting elements 200. FIG. 7 is an overhead view of the headlamp 100. The overhead view in FIG. 7 shows the plurality of light emitting elements 200 attached to a circuit board 202. FIG. 7 also shows the headlamp reflector 206 that surrounds the plurality of light emitting elements 200. The optical lens 208 and other components are omitted from FIG. 7 to aid the discussion of the arrangement 700 of light emitting elements 200.

FIG. 8 shows a more detailed, overhead view of the plurality of light emitting elements 200 in the arrangement 700 shown in FIG. 7. FIG. 8 shows that the plurality of light emitting elements 200 includes a first set 300 of light emitting elements 200 and a second set 302 of light emitting elements 200. The first set 300 and the second set 302 are arrangement with respect to each other on the circuit board 202.

Figure 14:
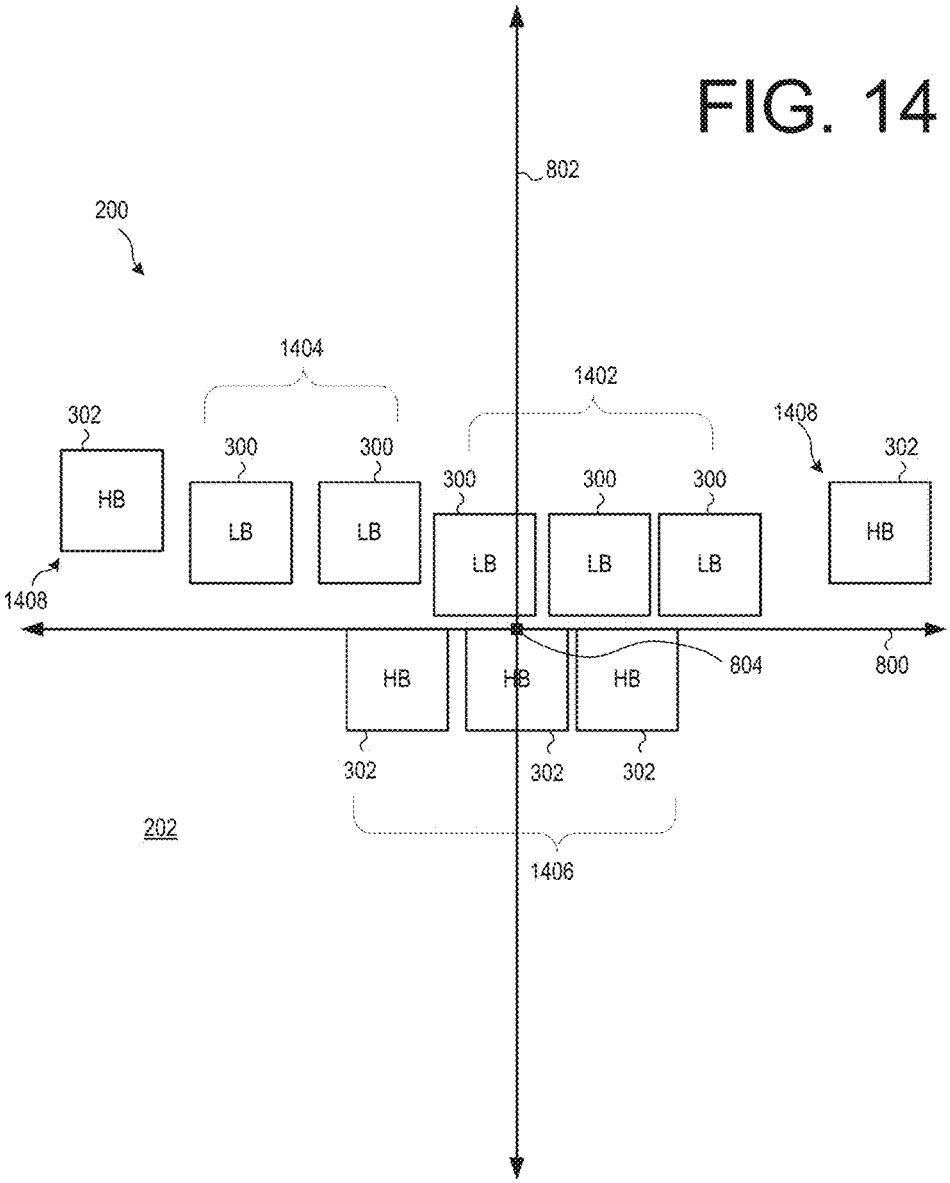
FIG. 14 is a close-up view of the dual high-beam and low-beam headlamp assembly having the an arrangement of light emitting elements shown in FIG. 13 according to other disclosed embodiments.

FIGS. 8 and 14 (discussed further below) shows the each of the light emitting elements 200 as rectangular shapes. However, the light emitting elements are not limited to this shape. Furthermore, the first set 300 of light emitting elements 200 is labeled as "LB" to represent a low-beam set of light emitting elements 200 in FIG. 8, and the second set 302 of light emitting elements 200 is labeled as "HB" to represent a high-beam set of light emitting elements in FIGS. 8 and 14. However, this designation does not limit the light emitting elements. For example, one or more of the first set 300 of light emitting elements 200 may generate light in the formation of the high-beam light pattern along with the second set 302 of light emitting elements 200.

FIG. 8 shows a first reference line 800 and a second reference line 802 that extends perpendicular to the first reference line 800. The first reference line 800 and the second reference line 802 intersects at an intersection 804. The first reference line 800 extends in same direction as (i.e., parallel to) both the first set 300 and the second set 302 of light emitting elements 200.

In some embodiments, the intersection 804 of the first reference line 800 and the second reference line 802 may be located at the center of the circuit board 202. In other embodiments, the intersection 804 may be located at a different position on the circuit board 202.

As discussed above, the optical lens 208 and the plurality of light emitting elements 200 optically form a high-beam light pattern and a low-beam light pattern. The arrangement of the light emitting elements that are turned on affects which of the patterns are formed. FIGS. 9-12 show different light patterns optically formed via the optical lens 208 and the plurality of light emitting elements 200.

FIG. 8 also shows that the first set 300 of the light emitting elements 200 are arranged adjacent to each other in a staggered arrangement on the circuit board 202. The second set 302 of the light emitting elements 200 may also be arranged adjacent to each other in a staggered arrangement. FIG. 8 also shows that the arrangement of the first set 300 of the light emitting elements 200 may mirror the arrangement of the second set 302 of the plurality of light emitting elements 200. However, the arrangement of the plurality of light emitting elements 200 is not limited to this particular arrangement.

FIG. 8 also shows that one or more of the first set 300 of light emitting elements 200 may be located above the first reference line 800. One or more of the first set 300 of light emitting elements may intersect the first reference line 800 or the second reference line 802, or both the first and second reference lines 800, 802. FIG. 8 also shows that one or more of the second set 302 of light emitting elements 200 may be located below the first reference line 800. One or more of the second set 302 of light emitting elements may intersect the first reference line 800 or the second reference line 802, or both the first and the second reference line 800, 802.

Figure 9:
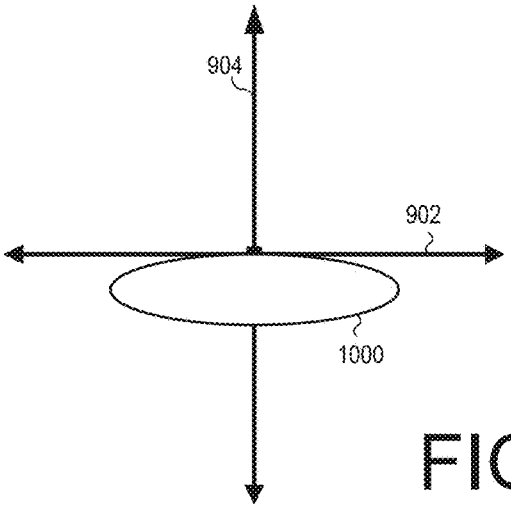
FIG. 9 is a front view of a low-beam light pattern projected by the dual high-beam and low-beam headlamp assembly according to the disclosed embodiments.

FIG. 9 shows a low-beam light pattern 1000 with respect to a horizontal axis 902 and a vertical axis 904. Note that the horizontal axis 902 and the vertical axis 904 are different from the first reference line 800 and the second reference line 802. This is because the first reference line 800 and the second reference line 802 are located on a circuit board 202. on the other hand, the horizontal axis 902 and the vertical axis 902 are outside of the headlamp 100. For example, the horizontal axis 902 may correspond to the horizon.

Figure 10:
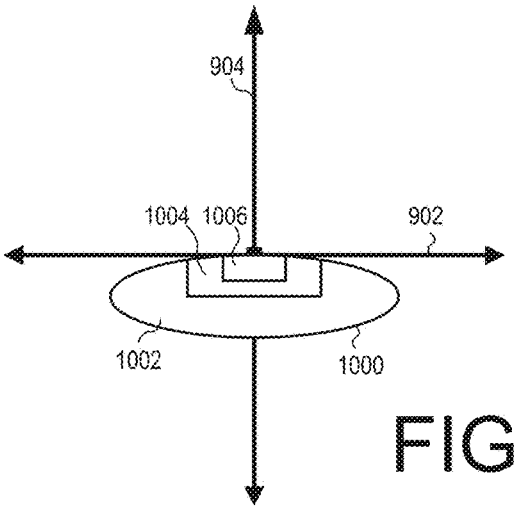
FIG. 10 is a front, detailed view of the low-beam light pattern projected by the dual high-beam and low-beam headlamp assembly shown in FIG. 9 according to the disclosed embodiments.

FIG. 10 shows a detailed view of the low-beam light pattern 1000 shown in FIG. 9. That is, FIG. 10 shows the different light-intensity areas located within the low-beam light pattern 1000, as will be understood by one skilled in the art. The low-beam light pattern 1000 may include a spread-light portion 1002 and a hot-spot 1006. The hot-spot 1006 of the low-beam light pattern 1000 has a higher intensity than the spread-light portion 1002. The low-beam light pattern 1000 may also include a blend-light portion 1004 that has a light intensity in between the hot-spot 1006 and the spread-light portion 1002.

Figure 11:
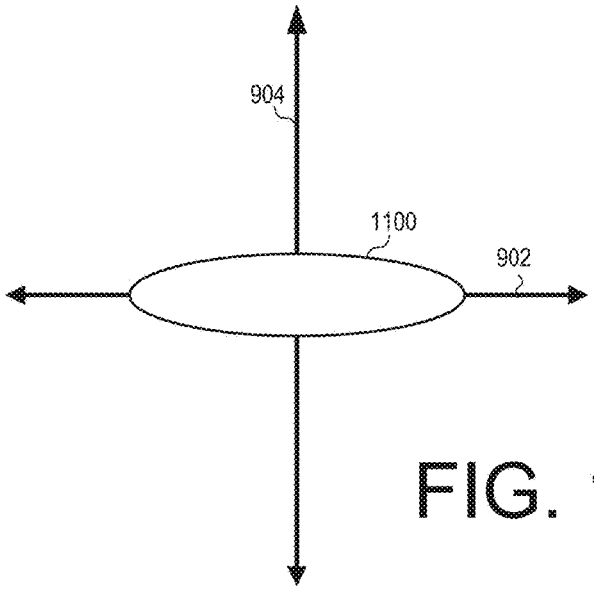
FIG. 11 is a front view of a high-beam light pattern projected by the dual high-beam and low-beam headlamp assembly according to the disclosed embodiments.

FIG. 11 shows a high-beam light pattern 1100 with respect to the horizontal axis 902 and the vertical axis 904. The high-beam light pattern 1100 is located above the horizontal axis 902 and is located at a higher position with respect to the horizontal axis 902 and the vertical axis 904 than the low-beam light pattern 1000. FIG. 11 shows that relative intensities of the high-beam light pattern 110.

Figure 12:
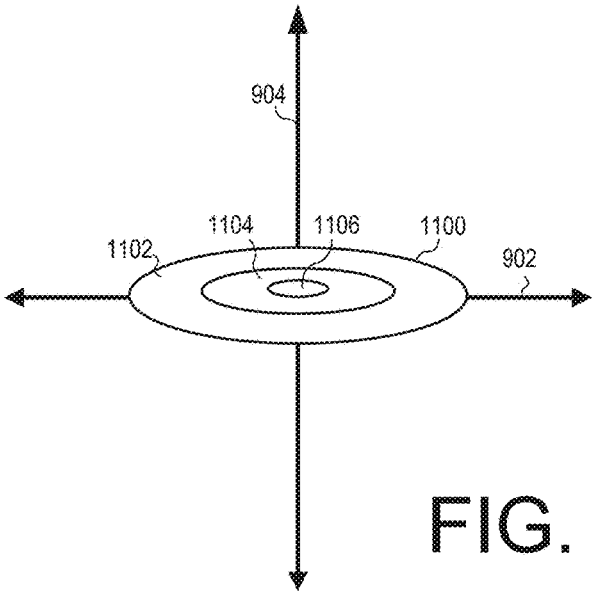
FIG. 12 is a front, detailed view of the high-beam light pattern projected by the dual high-beam and low-beam headlamp assembly shown in FIG. 11 according to the disclosed embodiments.

As shown in FIG. 12, the high-beam light pattern 1100 includes a spread-light portion 1102, a blend-light portion 1104, and a hot spot 1106. The hot spot 1106 has a greater intensity than the spread-light portion 1102, and the blend-light portion 1104 has an intensity less than the hot spot 1106 and more than the spread-light portion 1102 of the high-beam light pattern 1100.

As discussed above, the optical lens 208 and the plurality of light emitting elements 200 cooperate or work together to form the low-beam light pattern 1000 and the high-beam light pattern 1100. For example, each of the first set 300 of the plurality of light emitting elements 200 (such as shown in FIG. 8) may be turned on to generate light. The light generated by the first set 300 travels through the optical lens 208 (see FIG. 4), and the optical lens 208 optically forms the low-beam light pattern 1000. An example of a low-beam light pattern 1000 can be seen in FIGS. 9 and 10.

On the other hand, the headlamp 100 also includes a second set 302 of light emitting elements 200 on the same circuit board 202 as the first set 300 of light emitting elements 200 that generated the low-beam light pattern 1000. The second set 302 may turn on to generate light towards the optical lens 300 (such as shown in FIGS. 5 and 6). The optical lens 300 then optically forms a high-beam light pattern 1100 via the light generated by the second set 302 of light emitting elements 200. An example of a high-beam light pattern 1100 can be seen in FIGS. 11 and 12.

In various embodiments of the headlamp 100, one or more of the first set 300 of light emitting elements 200 may remain on as the second set 302 turns on to form the high-beam light pattern 1100. As shown in FIG. 5, both the entire second set 302 and one or more of the first set 300 of light emitting elements 200 are on generate light for the optical lens 208 to form the high-beam light pattern 1100. In other embodiments, all of the first set 300 and the second set 302 may turn on in order to form the high-beam light pattern 1100. In other embodiments, none of the first set 300 of light emitting elements 200 remain on (i.e., all turn OFF) in order to form the high-beam light pattern 110 as all of the second set 302 of light emitting elements 200 turn ON.

The particular arrangement of light emitting elements 200 is not limited. As mentioned above, certain regulatory requirements of different regulatory agencies (such as those in Europe and Japan) may require different light patterns than the light pattern requirements for the United States.

Figure 13:
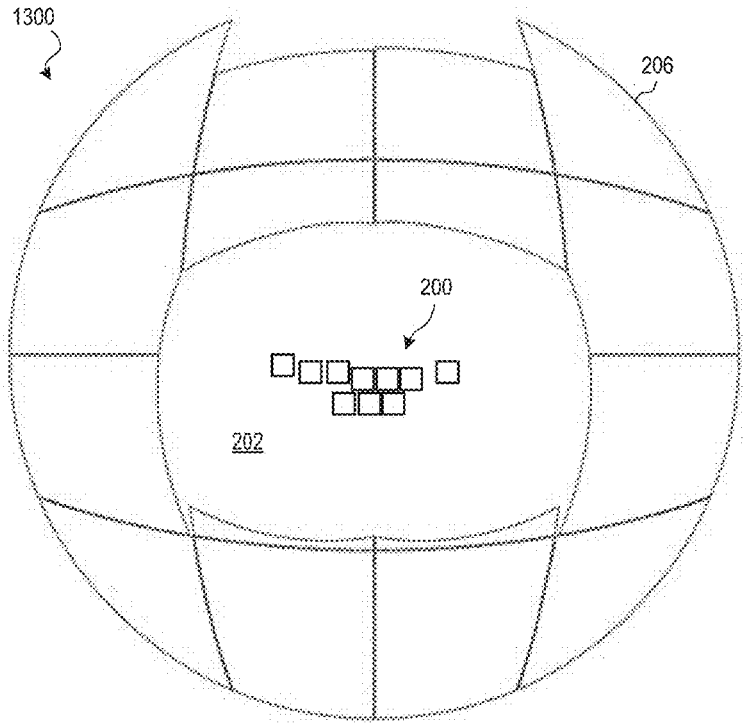
FIG. 13 is a top view of the dual high-beam and low-beam headlamp assembly having an arrangement of light emitting elements according to the disclosed embodiments.

FIGS. 13 and 14 show an arrangement 1300 of light emitting elements 200 (e.g., a high beam and a low beam arrangement). FIG. 13 shows an overhead view of the headlamp with the optical lens 208 (and other components) omitted for purposes of clarity. FIG. 13 shows the light emitting elements 200 on a circuit board 202. The light emitting elements 200 are surrounded by a headlamp reflector 206.

FIG. 14 provides a more detailed view of the arrangement 1300 shown in FIG. 13. As shown in FIG. 14, the plurality of light emitting elements 200 includes a first set 300 and a second set 302 of light emitting elements. The first set 300 and the second set 302 may be arranged on the circuit board 202 with respect to the first reference line 800 and the second reference line 802.

Similar to FIG. 8, the first reference line 800 and the second reference line 802 extend particular to each other and intersect at an intersection 804 as shown in FIG. 14. In some embodiments, the intersection 804 may be located at a center point (or a geometric center) of the circuit board 202. However, this is not limited to this arrangement.

The first set 300 may include multiple different rows of light emitting elements. FIG. 14 shows that the first set 300 includes a first row 1402 and a second row 1404 of light emitting elements 200. FIG. 14 shows that the first row 1402 may be located closer to the first reference line 800 than the second row 1404 of light emitting elements 1404. The first reference line 800 extends in the same direction (i.e., parallel to) the direction in which the first set 300 and the second set 302 of light emitting elements 200 extend. That is, the first reference lines 800 extends in the same direction as the first set 300 and the second set 302 of light emitting elements 300.

The term "row" does not necessarily mean that the light emitting elements 200 are perfectly aligned in parallel with respect to their outer edges. Instead, the term "row" means that the center of each of the light emitting elements 200 may be arranged substantially parallel to each other with respect to one of the first reference line 800 and the second reference line 802. In other words, the light emitting elements 200 are rotated in some embodiments so that the outer edges of the light emitting elements 200 do not align perfectly with each other.

FIG. 14 also shows that the second set 302 may include multiple different rows of light emitting elements 200. The second set 302 may include a first row 1406 and a second row 1408. The first row 1406 of the second set 302 is located closer to the intersection 804 of the first and second reference lines 800, 802 than the second row 1408 of the second set 302 of light emitting elements 200. The second row 1408 is located outside of the first set 300 of light emitting elements 200 such that the first set 300 is located between the second row 1408 of the second set 302.

The first set 300 of light emitting elements 200 are located closer to the intersection 804 of the first and second reference lines 800, 802 than the second row 1408 of the second set 302 of light emitting elements 200. In other words, the second row 1408 of the second set 302 is located closer to an outer edge of the circuit board 202 than the first set 302 of light emitting elements and the second row 1406 of the second set 302. Because of this, the first row 1406 of the second set 302 may be referred to as an inner row, and the second row 1408 may be referred to as an outer row with respect to the intersection 804 of the first and second reference lines 800, 802.

As shown in FIG. 14, the first row 1406 of the second set 302 may be located closer to the first reference line 800 than the second set 1408 of the second set 302. The first row 1406 may be located closer to the first reference line 800 than one or both of the first row 1402 and the second row 1404 of the first set 300.

Figure 15:
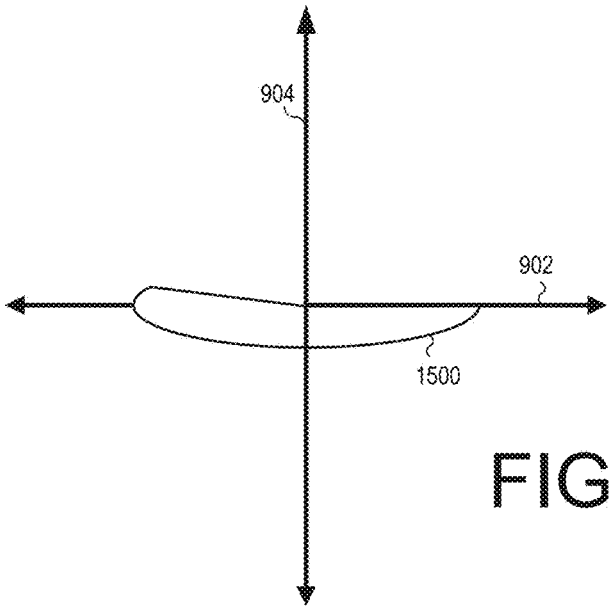
FIG. 15 is a front view of a low-beam light pattern projected by the dual high-beam and low-beam headlamp assembly according to the disclosed embodiments.
Figure 16:
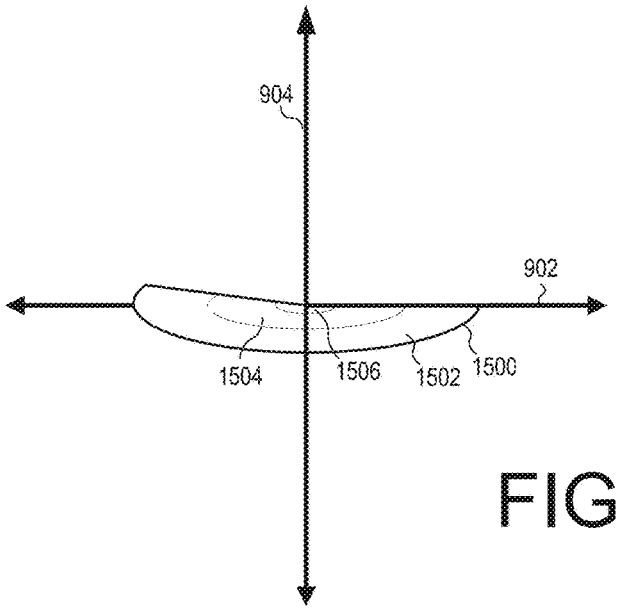
FIG. 16 is a front, detailed view of the low-beam light pattern projected by the dual high-beam and low-beam headlamp assembly shown in FIG. 15 according to the disclosed embodiments.

As explained above the plurality of light emitting elements 200 generate light towards the optical lens 208. The optical lens 208 optically forms a low-beam light pattern 1000 or a high-beam light pattern 1100 depending on which of the light emitting elements 200 are turned ON. FIGS. 15 and 16 shows a low-beam light pattern 1500 that is different from the shape of the low-beam light pattern 1000 shown in FIGS. 9 and 10. The optical lens 208 may form the low-beam light pattern 1500 of FIGS. 15 and 16 from the arrangement of light emitting elements 200 shown in FIGS.

13 and 14. The different light patterns may be due to different regulatory requirements.

FIG. 15 shows a low-beam light pattern 1500 with respect to a horizontal axis 902 and a vertical axis 904. The low-beam light pattern 1500 is shaped such that a portion of the low-beam light pattern 1500 substantially aligns with the horizontal axis 902 and that a portion of the low-beam light pattern 1500 is located above the horizontal axis 902. The portion above the low-beam light pattern 1500 may be referred to as a wedge or a slice. The wedge of low-beam light pattern 1500 may extends above horizontal axis 902 may form an angle of, for example, 15° above the horizontal axis 902. However, the angle of the wedge is not particularly limited to 15°. For example, the wedge may be any angle, or any angle range, between 1° and 90° above the horizontal axis 902. Furthermore, the wedge may occur on different sides of the horizontal axis 902 with respect to the vertical axis 904 in order to accommodate different countries that drive on different sides of the road (i.e., right-hand drive or left-hand drive).

The low-beam light pattern 1500 shown in FIG. 16 includes a spread-light portion 1502 and a hot spot 1506. The low-beam light pattern 1500 also includes a blend-light portion 1504 that is located between the hot spot 1506 and the spread-light portion 1502. The hot spot 1506 has a higher intensity than the spread-light portion 1504, and the blend-light portion 1504 has an intensity less than the hot spot 1506 and greater than the spread-light portion 1502.

To form the low-beam light pattern 1500, the headlamp 100 turns on the first set 300 of light emitting elements 200. The first set 300 of light emitting elements 200 generate light towards the optical lens 208 (such as shown in FIG. 4). The optical lens 208 then optically forms the low-beam light pattern 1500. This occurs without blocking any of the light generated from the light emitting elements 200.

To form a high-beam light pattern 1100, the second set 302 of light emitting elements 200 are turned on to generate light toward the optical lens 208. As shown in FIG. 5, both the first row 1406 and the second row 1408 may be turned on in the formation of the high-beam light pattern 1100. The high-beam light pattern may be similar to the high-beam light pattern shown in FIGS. 11 and 12. In addition, one or more of the first set 300 of light emitting elements may turn on to aid in the formation of the high-beam light pattern 1100, as shown in FIG. 5. on the other hand, the first set 300 of light emitting elements may turn off during the formation of the high-beam light pattern 1100.

As discussed above, the particular arrangement of light emitting elements 200 is not limited. Different arrangements and configurations of the plurality of light emitting elements 200 are found in some embodiments. The light emitting elements 200 are arranged on the circuit board 202 such that when one or more of the light emitting elements 200 turn on while others turn/remain OFF, the optical lens 208 forms a low-beam light pattern and such that when one or more of the light emitting elements 200 turn ON, the optical lens 208 forms a high-beam light pattern.

FIGS. 17-21 show overhead views of different arrangements of the plurality of light emitting elements 200 arranged on the circuit board 202 and with respect to the headlamp reflector 206.

Figure 17:
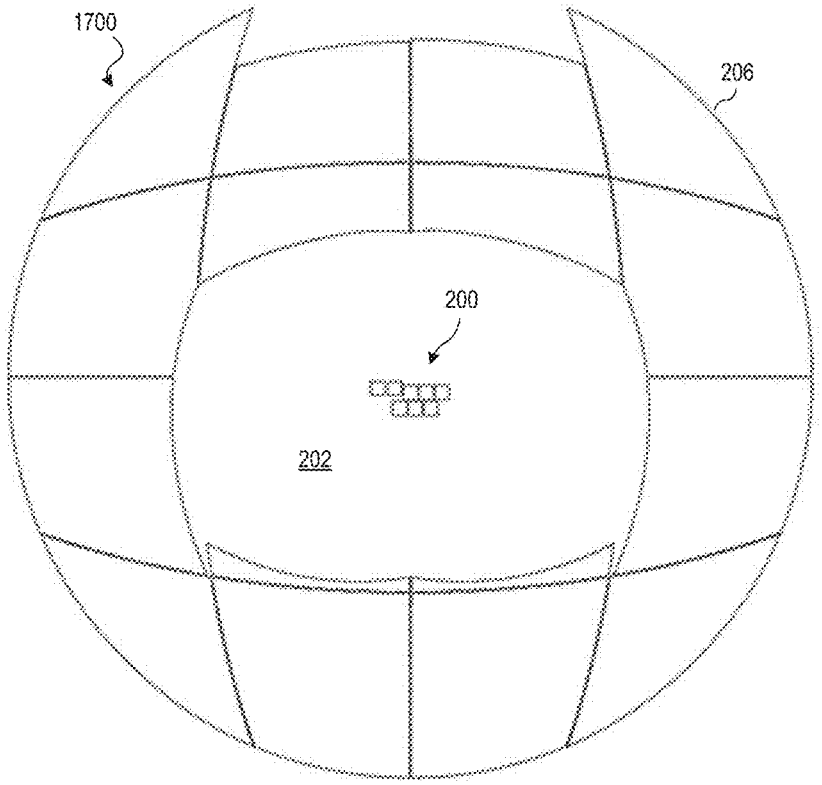
FIG. 17 is a top view of the dual high-beam and low-beam headlamp assembly having an arrangement of light emitting elements according to the disclosed embodiments.
Figure 18:
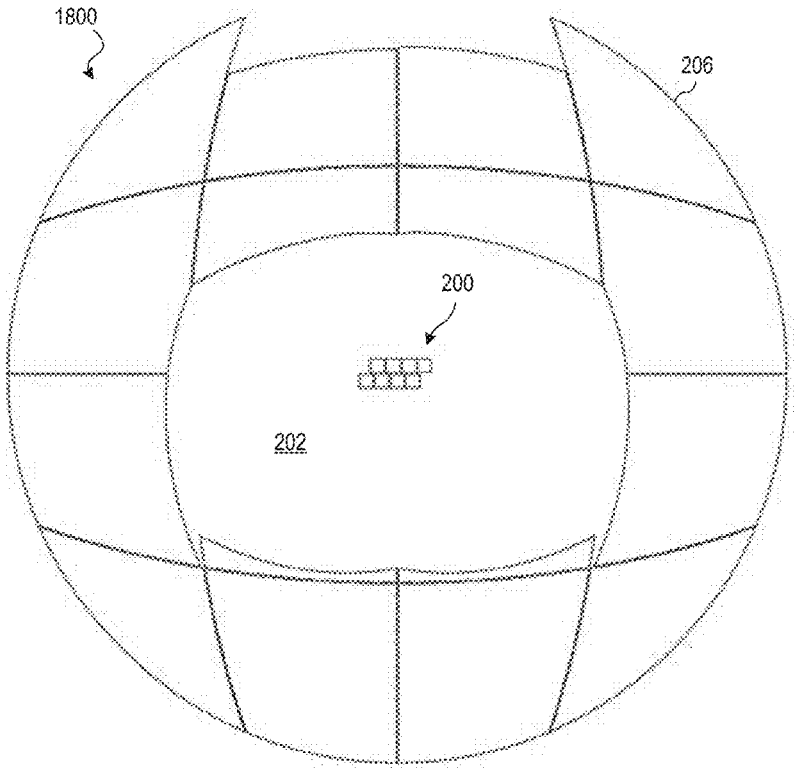
FIG. 18 is a top view of the dual high-beam and low-beam headlamp assembly having an arrangement of light emitting elements according to the disclosed embodiments.

FIG. 17 shows an arrangement 1700 of the light emitting elements 200 attached to a circuit board 202 with respect to the headlamp reflector 206 of the headlamp 100. FIG. 18 shows an arrangement 1800 of the light emitting elements 200 attached to a circuit board 202 with respect to the headlamp reflector 206. The arrangements 1700, 1800 of the light emitting elements 200 shown in FIGS. 17 and 18 show the light emitting elements 200 aligned relatively close together. However, the arrangement of the light emitting elements 200 is not limited to this arrangement.

Figure 19:
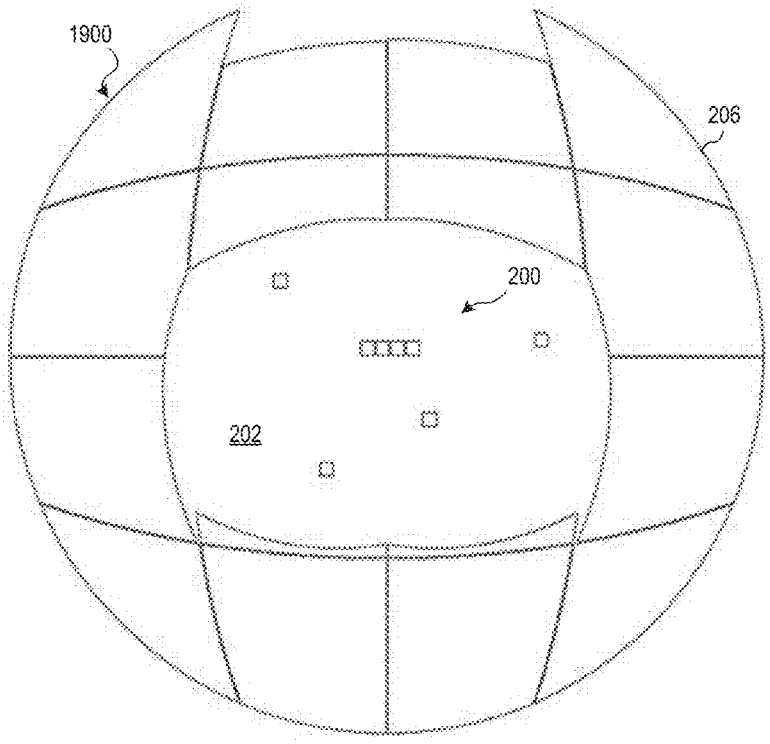
FIG. 19 is a top view of the dual high-beam and low-beam headlamp assembly having an arrangement of light emitting elements according to the disclosed embodiments.
Figure 20:
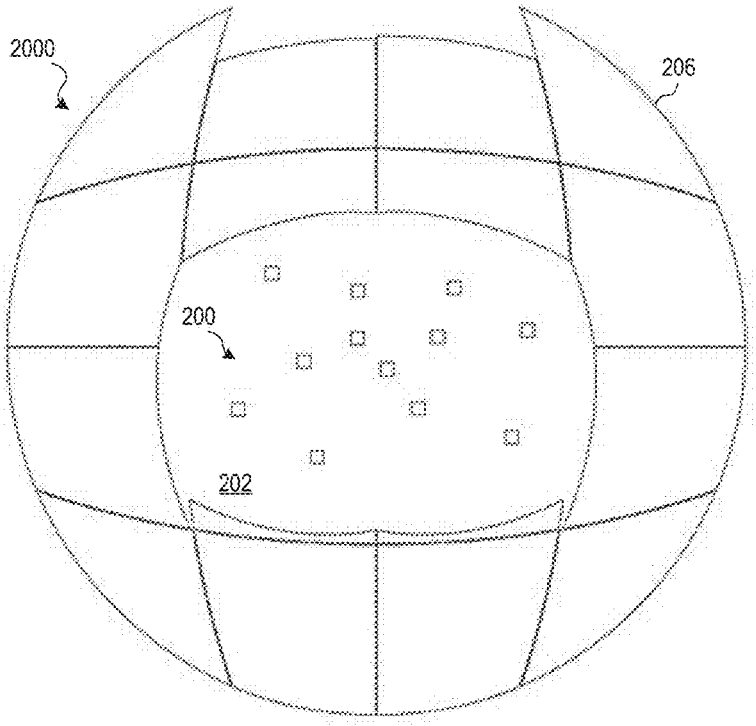
FIG. 20 is a top view of the dual high-beam and low-beam headlamp assembly having a scattered arrangement of light emitting elements according to the disclosed embodiments.

For example, FIGS. 19 and 20 show arrangements in which one or more of the light emitting elements 200 are spread out on the circuit board 202. FIG. 19 shows a row of light emitting elements and light emitting elements 200 that are located at various positions on the circuit board 202. on the other hand, FIG. 20 shows an arrangement 2000 in which the plurality of light emitting elements 200 are spread throughout the circuit board 202. The arrangement 2000 shown in FIG. 20 does not include any rows of light emitting elements 200.

Figure 21:
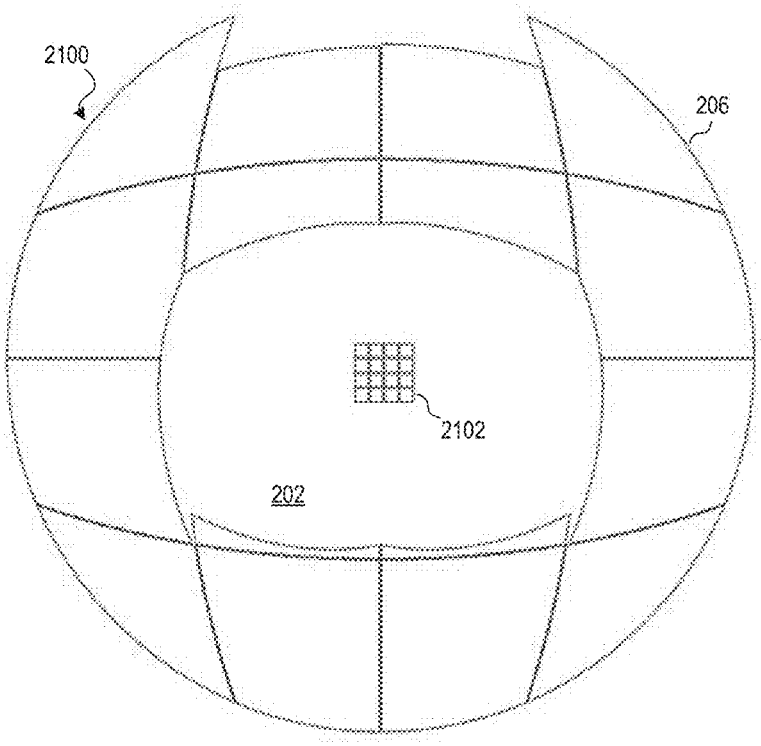
FIG. 21 is a top view of the dual high-beam and low-beam headlamp assembly having a matrix arrangement of light emitting elements according to the disclosed embodiments.

The plurality of light emitting elements 200 may also be arranged in a two-dimensional matrix 2102. FIG. 21 shows a matrix arrangement 2100. The light emitting elements 200 are aligned in a two-dimensional matrix of rows and columns. The matrix 2100 of FIG. 21 shows a square matrix of four rows and four columns of light emitting elements 200. However, the arrangement of the light emitting elements 200 is not limited to this number and may include more or less rows and columns. Furthermore, the matrix 200 may also be a rectangular matrix.

Figure 22:
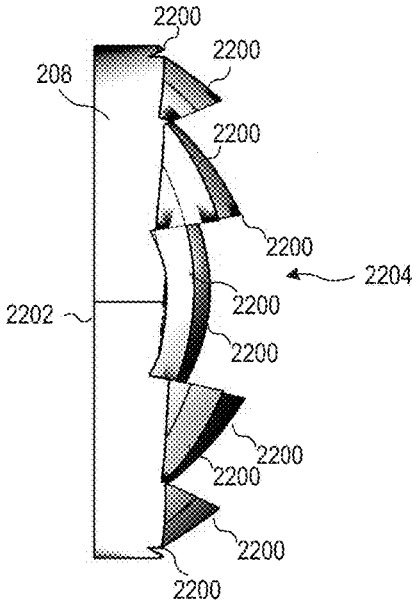
FIG. 22 is a cross-sectional side view of an optical lens of the dual high-beam and low-beam headlamp assembly according to the disclosed embodiments in which shading is added for illustrative purposes.
Figure 23:
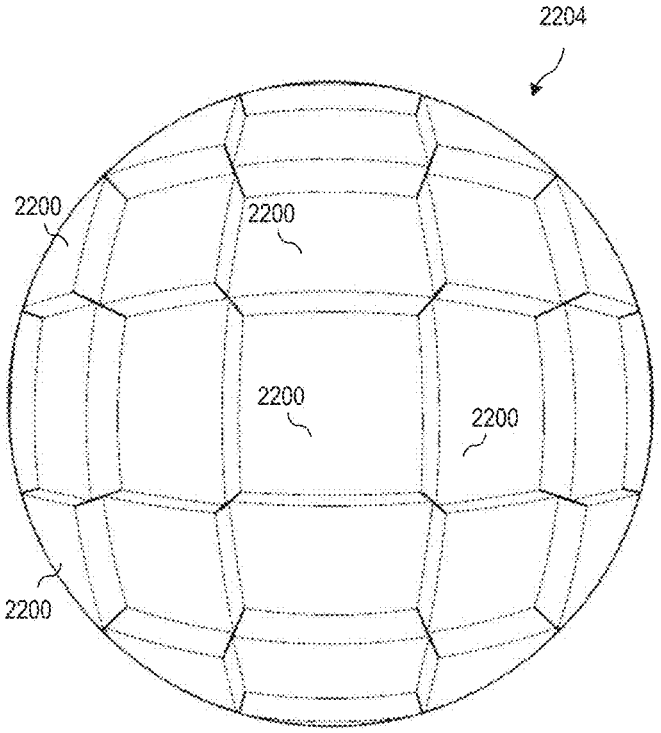
FIG. 23 is a perspective view of an optical lens of the dual high-beam and low-beam headlamp assembly according to the disclosed embodiments.

FIGS. 22 and 23 show different views of the optical lens 208. FIG. 22 shows a cross-sectional side view with shading for illustrative purposes. FIG. 23 shows an overhead view of the optical lens 208.

As explained above, the light emitting elements 200 generate light towards an optical lens 208 of the headlamp 100, as shown in FIGS. 4-6. The optical lens 208 optically forms a low-beam light pattern or a high-beam light pattern depending on which of the light emitting elements 200 are turned on and the particular arrangement of the light emitting elements 200 on the circuit board 202. The outer surfaces of an optical lens 208 determine its optical characteristics for the formation of different light patterns.

The optical lens 208 may include a first outer surface and a second outer surface opposite to the first outer surface. One or more of the first and the second surfaces 2204 may be shaped to have optical properties to optically form different light patterns. In some embodiments, both the first outer surface and the second outer surface have optical properties, and are referred to as a first optical surface 2202 and the second optical surface 2204.

The first optical surface 2202 may be generally planar. The second surface 2204 may include a plurality of segments 2200 that outwardly extend from the optical lens 208 (i.e., away from the first surface 2202). The shape of each of the segments 2200 of the optical lens 208 bends the light generated by the light emitting elements 200 to optically form the high-beam light pattern or the low-beam light pattern (depending on which of the light emitting elements 200 are turned on or OFF).

To form the segments 2000 in an optical lens, one or more surfaces of a lens (such as plano-convex lens) may be cut in multiple slices to produce the second optical surface 2204. The interior of the optical lens is then removed, and segments 2000 are moved to be aligned on the same plane. Different types of slices (and angles) are made in some embodiments such that the optical properties of the second surface 2204 can optically form both a high-beam light pattern 1100 and a low-beam light pattern 1000, 1500 in cooperation with the arrangement of the light emitting elements 200 on the circuit board 202. An example of a method for forming slices in an optical lens is discussed in commonly-assigned U.S. patent application Ser. No. 15/232,134, which is hereby incorporated by reference herein in its entirety.

FIG. 23 shows an overhead view of the second surface 2204 of the optical lens 208. The segments 2200 are formed in different arrangements to allow the optical lens 208 to form both the high-beam light pattern and the low-beam light pattern.

In some embodiments, the first surface 2202 faces the light emitting elements 200, and the second surface 2204 faces away from the light emitting elements 200 (i.e., toward the protective lens 212). In other embodiments, the second surface 2204 faces the light emitting elements 200, and the first surface 2202 faces away from the light emitting elements 200.

The optical lens 208 may be made of any optical material. For example, the optical lens 208 may be made of glass, polycarbonate, acrylic, silicon, or a similar optical material. The optical lens 208 may have a thickness of about 2 mm and a diameter of about 10 mm. The optical lens 208 may be a circular or a rectangular shape (viewed from an overhead perspective such as FIG. 23).

The segments 2200 of the optical lens are made of the same material as the optical lens 208. This material is transparent in some embodiments. FIG. 22 includes shading so that the segments 2200 can be more easily distinguished in the view shown in FIG. 22.

Figure 24:
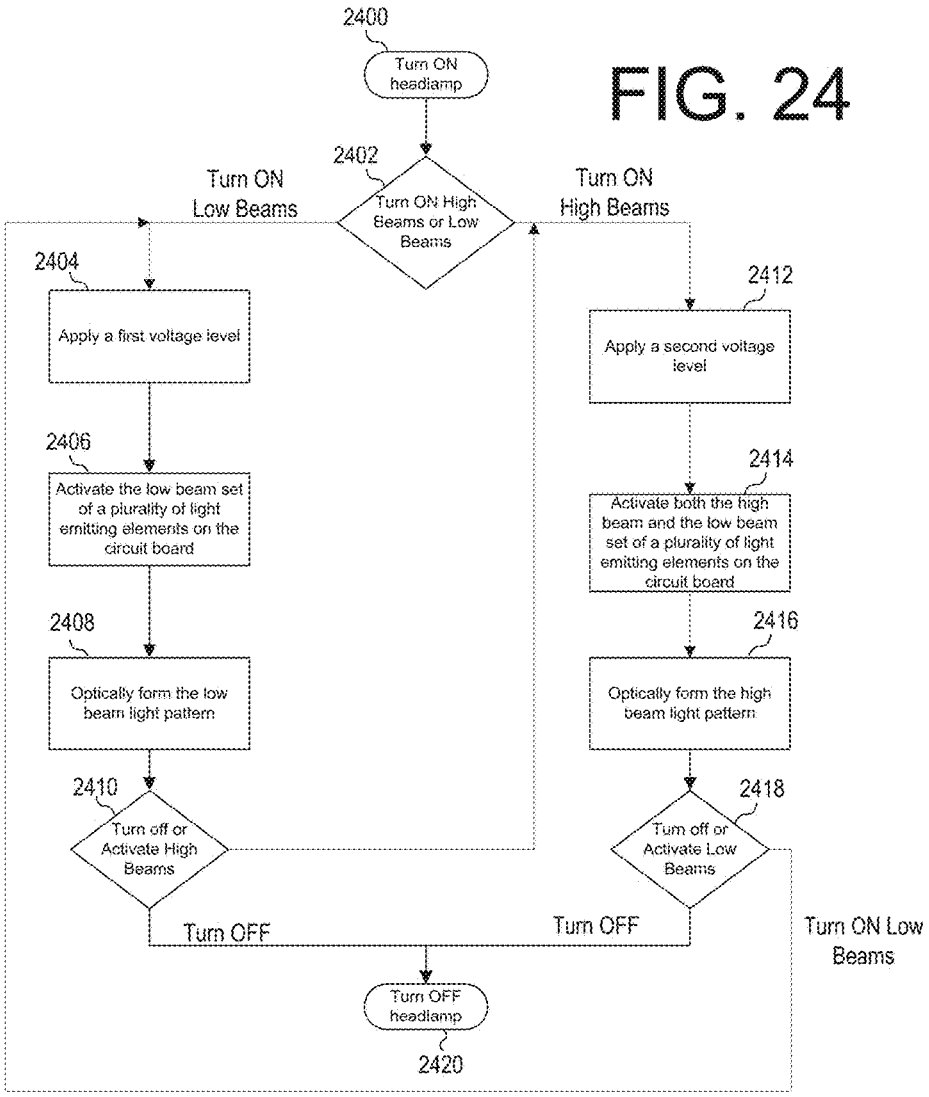
FIG. 24 is flow chart showing control of the dual high-beam and low-beam headlamp assembly according to the disclosed embodiments.
Figure 25:
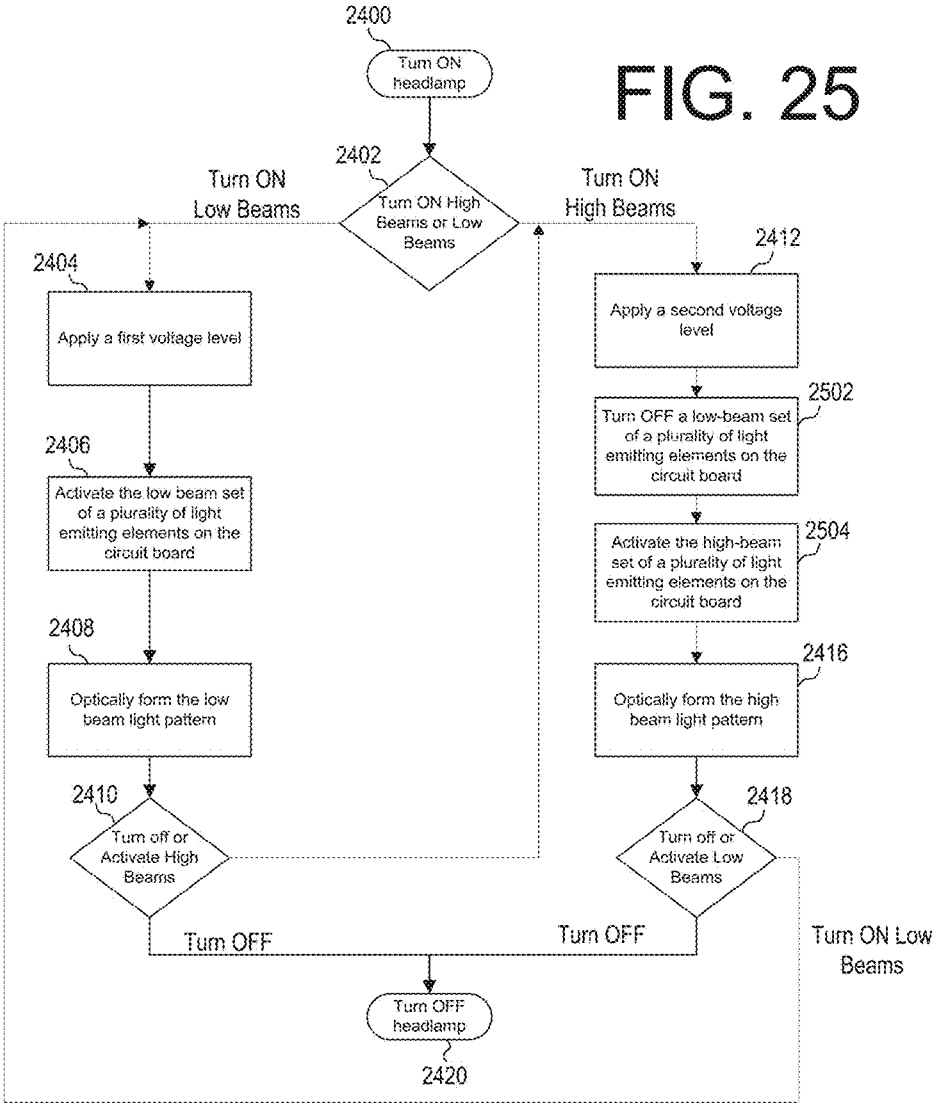
FIG. 25 is flow chart showing control of the dual high-beam and low-beam headlamp assembly according to the disclosed embodiments.

FIGS. 24 and 25 show flowcharts for forming the high-beam light pattern and the low-beam light patterns. As explained above, one or more of the first set 300 and the second set 302 are turned on or off to generate light towards the optical lens 208, which the optical lens 208 forms into the corresponding low-beam light pattern or high-beam light pattern.

FIGS. 24 and 25 refer to a low-beam set of light emitting elements 200 and a high-beam set of light emitting elements 200 these light emitting elements 200. The low-beam set of light emitting elements 200 corresponds to the first set 300 of light emitting elements 200 discussed above. In some embodiments, the high-beam set of light emitting elements 200 corresponds to the second set 302 of light emitting elements 200. In other embodiments, the high-beam set of light emitting elements 200 corresponds to both the first and second set 300, 302 of the light emitting elements 200. As explained above, the optical lens 208 may form the high-beam light pattern either when the second set 302 is turned on and one or more of the first set 300 are turned on or when the second set 302 is turned on only.

As shown in FIG. 24, the headlamp 100 is turned on in initiation step 2400. After the process starts in step 2400, the headlamp 100 may turn on either the high beams or the low beams in step 2402. The high beams correspond to the formation of the high-beam light pattern, and the low beams correspond to the formation of the low-beam light pattern. To turn on the low beams, the flowchart proceeds to step 2404. In step 2404, a first voltage level is applied to activate the low beam set of the light emitting elements 200. For example, the first voltage level could correspond to a LOW voltage level that turns on the first set 300 of the light emitting elements 200. The first voltage level may not turn on the second set 302 of the light emitting elements 200 so that the low-beam light pattern can be formed. Blocking does not occur in the formation of the low-beam light pattern (or the high-beam light pattern).

After applying the first voltage level in step 2404, the low beam set of the plurality of light emitting elements 200 are turned ON. The low beam set generates light towards the optical lens 208, and the optical lens 208 subsequently forms the low-beam light pattern in step 2408.

After the low-beam light pattern is formed, the headlamp 100 can be turned on or the high beams can be turned ON. If the headlamp 100 is turned OFF, then the process proceeds to step 2420. If the high beams are to be turned ON, then the process proceeds to step 2412. In step 2412, a second voltage level is applied. The second voltage level may correspond to a HIGH voltage level that is higher than the first voltage level (e.g., the LOW voltage level).

In some embodiments, the second voltage level may be adequate to turn on both the low-beam set of light emitting elements 200 and the high-beam set of light emitting elements 200 in order to allow the formation of the high-beam light pattern. In other embodiments, the second voltage level turns on only the high-beam set of light emitting elements and turns off one or more, or all, of the low-beam light emitting elements. For example, the second voltage level may turn on both the first set 300 and the second set 302 of light emitting elements discussed above. In other embodiments, the second voltage level may turn on only the second set 302 of light emitting elements.

After the second voltage level is applied in step 2412, the headlamp may activate both the high-beam set and the low-beam set of light emitting elements 200 in step 2414. After doing so, both of the high-beam set and low-beam set of light emitting elements 200 generate light toward the optical lens 208. The optical lens then optically forms the high-beam light pattern from the generated light in step 2416.

After forming the high-beam light pattern, the headlamp 100 may be turned off or the low beams may be activated in step 2418. If the low beams are to be turned ON, then the process proceeds back to step 2404 to apply the first voltage level. on the other hand, if the headlamp 100 is to be turned off, then the process proceeds to step 2420 to turn off the headlamp.

As explained above, the formation of the high-beam light pattern may include turning on both the high-beam set and the low-beam set of light emitting elements 200. On the other hand, the formation of the high-beam light pattern may include turning on only the high beam set of light emitting elements 200. FIG. 25 provides a flowchart in which only the high beam set of light emitting elements 200 are turned on and the low beam set of light emitting elements 200 are turned OFF.

The flowchart of FIG. 25 includes similar steps as the flowchart of FIG. 24. Similar steps are indicated with similar reference numbers. In contrast with FIG. 24, FIG. 25 shows a different process after a second voltage level is applied in step 2412. After the second voltage level is applied, the low-beam set of light emitting elements 200 are turned off in step 2502. The low-beam set of light emitting elements 200 may correspond to the first set 300 of light emitting elements 200. Furthermore, the high-beam set of light emitting elements 200 are turned on in step 2504. The high-beam set of light emitting elements may correspond to the second set 302 of light emitting elements 200.

After the high-beam set of light emitting elements are turned ON, the high-beam set of light emitting elements generate light towards the optical lens 208. The optical lens 208 then optically forms the high-beam light pattern in step 2416. The reflector 206 may project and/or cooperate to optically form one or more of the light patterns of the headlamp 100.

In some embodiments, the process discussed above and shown in FIGS. 24 and 25 are implemented in the circuitry of the circuit board 202 and the light emitting element driver 204. In other embodiments, the circuit board 202 includes a controller 222, which includes internal memory or is electrically connected to external memory. The controller 222 is electrically connected to the light emitting element driver 204 and the light emitting elements 200. The controller 22 may refer to one or more of the following: an application specific integrated circuit (ASIC), an electronic circuit, a processor (shared, dedicated, or group) and memory that execute instructions, a microcomputer, a digital signal processor, a field-programmable gate array (FPGA), a combinational logic circuit, or other suitable components that provide and execute the processes and control features.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A headlamp assembly, comprising:

a headlamp reflector that includes a bottom, an outer edge, and a curved sidewall that extends outwardly from bottom to define the outer edge;

a circuit board that is attached to the bottom of the headlamp reflector and that includes a plurality of light emitting elements, the plurality of light emitting elements are arranged on the circuit board in a high-beam and low-beam producing pattern configured to generate light toward the outer edge of the headlamp reflector, the plurality of light emitting elements in the high-beam and low-beam producing pattern attached to the circuit board in a non-uniform arrangement;

an optical lens that is attached to the headlamp reflector, that includes a first optical surface and a second optical surface, and that is configured to cooperate with the non-uniform arrangement of the plurality of light emitting elements to optically form a low-beam light pattern and a high-beam light pattern from the light generated from the plurality of light emitting elements through the optical lens without shielding any components; and a housing that houses the circuit board, the plurality of light emitting elements, the optical lens, and the headlamp reflector.

2. The headlamp assembly according to claim 1, wherein the plurality of light emitting elements includes a first set of light emitting elements in a first light-beam pattern arrangement on the circuit board and a second set of light emitting elements in a second light-beam pattern arrangement.

3. The headlamp assembly according to claim 2, wherein the optical lens is configured to optically form the low-beam light pattern from the light generated by the first set of light emitting elements, and the optical lens is configured to optically form the high-beam light pattern from the light generated by the second set of light emitting elements and one or more of the light emitting elements in the first set of light emitting elements.

4. The headlamp assembly according to claim 2, wherein the optical lens is configured to optically form the low-beam light pattern from the light generated by the first set of light emitting elements, and the optical lens is configured to optically form the high-beam light pattern from the light generated by the second set of light emitting elements.

5. The headlamp assembly according to claim 1, further comprising an outer protective-lens that is attached to headlamp housing to enclose the optical lens, the headlamp reflector, and the circuit board.

6. The headlamp assembly according to claim 1, wherein the optical lens includes a plurality of segments that outwardly extend from one of the first optical surface and the second optical surface of the optical lens.

7. The headlamp assembly according to claim 6, wherein the first optical surface of the optical lens is planar, and the plurality of segments outwardly extend from the second optical surface of the optical lens.

8. The headlamp assembly according to claim 2, wherein the optical lens and the plurality of light emitting elements cooperate to optically form one of the high-beam light pattern or the low-beam light pattern by selectively activating one of the first set or the second set or both, respectively, without shielding any components to optically form the low beam pattern.

9. The headlamp assembly according to claim 2, wherein each of the light emitting elements in the first set of light emitting elements are attached to the circuit board in a row that extends in a same general direction on the circuit board, and each of the light emitting elements in the second set of light emitting elements are attached to the circuit board in a row that extends in a same general direction on the circuit board parallel to the first set of light emitting elements.

10. The headlamp assembly according to claim 2, wherein the first set of light emitting elements includes a first row and a second row of light emitting elements, and the second set of light emitting elements include a first row and a second row of light emitting elements, the second row of the second set is aligned adjacent to the first row and the second row of the first set such that the first row for the first set is located in between the second row of the second set, and the second row of the second set is closer to an outer edge of the circuit board than the first row and the second row of the first set of light emitting elements.

11. The headlamp assembly according to claim 1, wherein one or more of the plurality of light emitting elements in the high-beam and low-beam producing pattern on the circuit board are staggered on the circuit board.

12. A headlamp assembly, comprising:

a headlamp reflector that includes a bottom, an outer edge, and a curved sidewall that extends outwardly from bottom to define the outer edge;

an optical lens that is attached to the headlamp reflector;

a circuit board that is attached to the bottom of the headlamp reflector and that includes a plurality of light emitting elements attached to the circuit board in a non-uniform arrangement;

a high-beam set of the plurality of light emitting elements that is arranged on the circuit board in a high-beam producing pattern configured to cooperate with the optical lens to optically form a high beam pattern from the light emitted from the high-beam set through the optical lens;

a low-beam set of the plurality of light emitting elements, that is arranged on the circuit board in a low-beam producing pattern configured to cooperate with the optical lens to optically form a low beam pattern from the light emitted from the low-beam set through the optical lens without shielding any components and that is different than, or mixed with at least one of, the high-beam set of the plurality of light emitting elements; and a housing that includes an outer protective-lens and that houses the circuit board, the plurality of light emitting elements, the optical lens, and the headlamp reflector.

13. A method for controlling a dual beam headlamp, comprising:

applying a first voltage level to activate a low-beam set of a plurality of light emitting elements connected to a circuit board attached to a bottom of a headlamp reflector within a housing of a vehicle headlamp;

optically forming a low-beam pattern via an optical lens attached to the headlamp reflector and the low-beam set of the plurality of light emitting elements attached to the circuit board in a non-uniform arrangement without shielding any components of the vehicle headlamp to form the low-beam pattern, the plurality of light emitting elements including the high-beam set and low-beam set are attached to the circuit board in a non-uniform arrangement;

applying a second voltage level different from the first voltage level to activate a high-beam set of the plurality of light emitting elements that are different from the low-beam set of the plurality of light emitting elements and that are attached to the circuit board within the housing of the vehicle headlamp; and optically forming a high-beam pattern via the optical lens and the high-beam set of the plurality of light emitting elements.

14. The method for controlling the dual beam headlamp according to claim 13, further comprising emitting light from the low-beam set of the plurality of light emitting elements through the optical lens within the housing of the vehicle headlamp to optically form the low-beam pattern, and emitting light from the high-beam set of the plurality of light emitting elements through an optical lens within the housing of the vehicle headlamp to optically form the high-beam pattern.

* * * * *